US008712766B2

(12) United States Patent
Ashley et al.

(10) Patent No.: US 8,712,766 B2
(45) Date of Patent: Apr. 29, 2014

(54) METHOD AND SYSTEM FOR CODING AN INFORMATION SIGNAL USING CLOSED LOOP ADAPTIVE BIT ALLOCATION

(75) Inventors: James P. Ashley, Naperville, IL (US); Udar Mittal, Hoffman Estates, IL (US)

(73) Assignee: Motorola Mobility LLC, Chicago, IL (US)

( * ) Notice: Subject to any disclaimer, the term of this patent is extended or adjusted under 35 U.S.C. 154(b) by 2157 days.

(21) Appl. No.: 11/383,509

(22) Filed: May 16, 2006

(65) Prior Publication Data

US 2007/0271094 A1 Nov. 22, 2007

(51) Int. Cl.

| | |
|---|---|
| ***G10L 19/00*** | (2013.01) |
| ***G10L 19/12*** | (2013.01) |
| ***G10L 19/02*** | (2013.01) |

(52) U.S. Cl.

USPC ..... 704/220; 704/201; 704/219; 704/223; 704/229

(58) Field of Classification Search

CPC ... G10L 19/00; G10L 19/0019; G10L 19/002; G10L 19/04; G10L 19/08; G10L 19/083; G10L 19/09; G10L 19/10; G10L 19/107; G10L 19/113; G10L 19/12; G10L 19/125; G10L 19/13; G10L 2019/00; G10L 2019/0001; G10L 2019/0003; G10L 2019/0013; G10L 2019/0014; G10L 2019/0016

USPC ..... 704/201, 220, 219, 229, 223

See application file for complete search history.

(56) References Cited

U.S. PATENT DOCUMENTS

| | | | | |
|---|---|---|---|---|
| 5,513,297 | A | 4/1996 | Kleijn et al. | |
| 5,657,418 | A | 8/1997 | Gerson et al. | |
| 5,729,655 | A * | 3/1998 | Kolesnik et al. | 704/223 |
| 5,734,789 | A * | 3/1998 | Swaminathan et al. | 704/206 |
| 5,778,335 | A | 7/1998 | Ubale et al. | |
| 5,857,168 | A | 1/1999 | Ozawa | |
| 5,873,060 | A * | 2/1999 | Ozawa | 704/230 |
| 6,003,001 | A * | 12/1999 | Maeda | 704/223 |
| 6,141,638 | A | 10/2000 | Peng et al. | |
| 6,167,375 | A * | 12/2000 | Miseki et al. | 704/229 |
| 6,236,960 | B1 | 5/2001 | Peng et al. | |
| 6,240,386 | B1 * | 5/2001 | Thyssen et al. | 704/220 |
| 6,470,313 | B1 * | 10/2002 | Ojala | 704/223 |
| 6,594,626 | B2 * | 7/2003 | Suzuki et al. | 704/220 |
| 6,604,070 | B1 * | 8/2003 | Gao et al. | 704/222 |
| 6,662,154 | B2 * | 12/2003 | Mittal et al. | 704/219 |
| 6,714,907 | B2 * | 3/2004 | Gao | 704/220 |
| 6,810,381 | B1 * | 10/2004 | Sasaki et al. | 704/500 |
| 7,092,885 | B1 * | 8/2006 | Yamaura | 704/264 |
| 7,177,804 | B2 * | 2/2007 | Wang et al. | 704/219 |
| 7,266,793 | B1 * | 9/2007 | Agmon | 716/106 |
| 7,379,865 | B2 * | 5/2008 | Kang et al. | 704/219 |
| 2004/0093207 | A1 * | 5/2004 | Ashley et al. | 704/223 |

(Continued)

*Primary Examiner* — Paras D Shah

(57) ABSTRACT

A method and system for analysis-by-synthesis encoding of an information signal is provide. The encoder (400) can include the steps of generating a first synthetic signal based on a first pitch-related codebook (402), generating a second synthetic signal based on a second pitch-related codebook (404), selecting a codebook configuration parameter based on the reference signal and the first and second synthetic signals, and conveying the codebook configuration for use in reconstructing an estimate of the input signal. The encoder can include an error expression having an error bias (506) and a prediction gain having a prediction gain bias (508) for determining the codebook configuration. The encoder can employ variable length coding and combinatorial subframe coding (600) for efficiently compressing the codebook configuration parameter and codebook related parameters for one or more subframes.

26 Claims, 7 Drawing Sheets

(56) References Cited

U.S. PATENT DOCUMENTS

2005/0096901 A1* 5/2005 Uvliden et al. ..... 704/219
2006/0190246 A1* 8/2006 Park ..... 704/221
2007/0271102 A1* 11/2007 Morii ..... 704/268

* cited by examiner

200

- PRIOR ART -

- PRIOR ART -

500

700

METHOD AND SYSTEM FOR CODING AN INFORMATION SIGNAL USING CLOSED LOOP ADAPTIVE BIT ALLOCATION

CROSS-REFERENCE TO RELATED APPLICATION

This application is related to U.S. patent application Ser. No. 11/383,506, filed on the same date as this application.

FIELD OF THE INVENTION

The present invention relates, in general, to signal compression systems and, more particularly, to Code Excited Linear Prediction (CELP)-type speech coding systems.

BACKGROUND OF THE INVENTION

Compression of digital speech and audio signals is well known. Compression is generally required to efficiently transmit signals over a communications channel, or to store said compressed signals on a digital media device, such as a solid-state memory device or computer hard disk. Although there exist many compression (or "coding") techniques, one method that has remained very popular for digital speech coding is known as Code Excited Linear Prediction (CELP), which is one of a family of "analysis-by-synthesis" coding algorithms. Analysis-by-synthesis generally refers to a coding process by which multiple parameters of a digital model are used to synthesize a set of candidate signals that are compared to an input signal and analyzed for distortion. A set of parameters that yield the lowest distortion is then either transmitted or stored, and eventually used to reconstruct an estimate of the original input signal. CELP is a particular analysis-by-synthesis method that uses one or more codebooks that each essentially comprises sets of code-vectors that are retrieved from the codebook in response to a codebook index.

In modern CELP coders, there is a problem with maintaining high quality speech reproduction. The problem originates since there are too few bits available to appropriately model the "excitation" sequences or "codevectors" which are used as the stimulus to a synthesis filter. An improved method for determining the codebook related parameters has been described in U.S. patent application Ser. No. 11/383,506, filed on the same date as this application and is incorporated herein by reference. This method addresses a low complexity, joint optimization process and method. However, there remains a need for improving performance of CELP type speech coders at low bit rates.

DETAILED DESCRIPTION OF THE INVENTION

Figure 1:
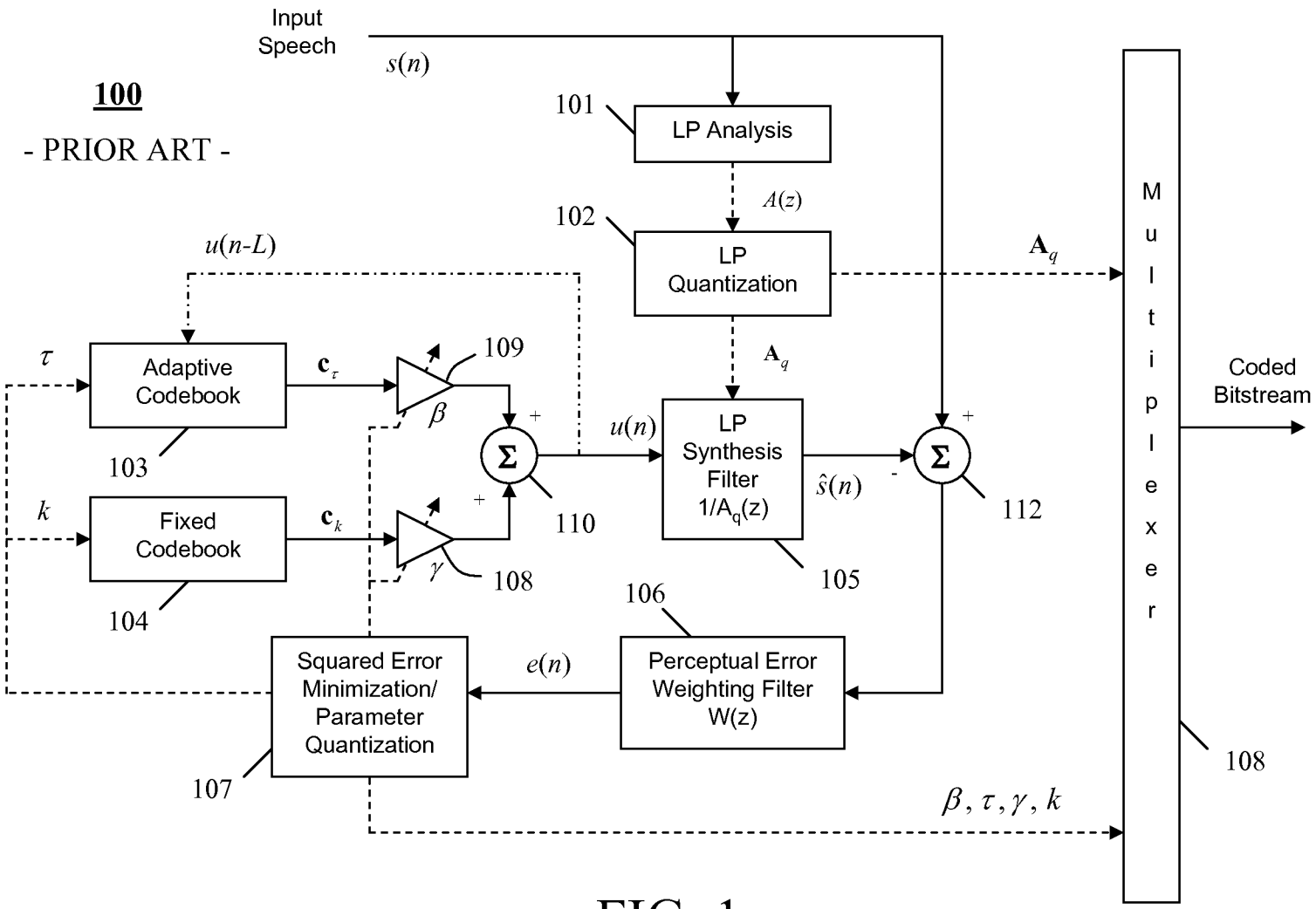
FIG. 1 is a block diagram of a Code Excited Linear Prediction (CELP) encoder of the prior art.

Embodiments of the invention concern a speech coder that varies a codebook configuration for efficiently coding a speech signal based on parameters extracted from the information signal. The codebook configuration determines the contribution of one or more codebooks used to code the speech signal. The codebook configuration can be associated with a codebook configuration parameter that describes a bit allocation between the one or more codebooks. For example, the codebook configuration parameter can identify an optimal number of bits in a pitch related codebook and a corresponding optimal number of bits in a fixed codebook. The speech coder can identify the optimal number of bits for the bit allocation between two or more codebook based on one or more performance metrics during a coding of the speech signal. In one example, a first performance metric can be a squared error metric and a second performance metric can be a prediction gain metric.

Stated specifically, a method and system for adaptive bit allocation among a set of codebooks and codebook related parameters is provided. The method provides a low complexity, codebook optimization process to increase speech modeling performance of CELP type speech coders at low bit rates. In practice, a combination of fixed codebook and adaptive codebook contributions are determined based on one or more performance metrics. A codebook configuration is determined from the one or more performance metrics. Upon selection of the codebook configuration, multiple related codebook parameters are determined. The performance metrics identify a contribution of the adaptive codebook and a contribution of the fixed codebook that increases information modeling accuracy. That is, for certain types of speech, a bit-allocation for the adaptive codebooks and the fixed codebooks is adjusted to minimize an error criterion, wherein the bit-allocation establishes the contribution of each of the codebooks. The method and system can dynamically allocate bits to the adaptive codebook and fixed codebook components, such that an increase in overall performance is attained with reduced overhead in computational complexity and memory.

One example of the speech coder of the current invention implements a method for analysis-by-synthesis encoding of an information signal. The method can include the steps of generating a weighted reference signal based on the information signal, generating a first synthetic signal based on a first pitch-related codebook, generating a first performance metric between the reference signal and the first synthetic signal, generating a second synthetic signal based on a second pitch-related codebook, generating a second performance metric between the reference signal and the second synthetic signal, selecting a codebook configuration parameter based on the first and second performance metrics, and outputting the codebook configuration parameter for use in reconstructing an estimate of the input signal.

In another embodiment, one or more codebook configuration parameters can be determined for a speech frame and encoded in a variable length code word. For example, a codebook configuration can be determined for one or more subframes of the speech frame. Each subframe can have a corresponding configuration parameter associated with the subframe. In one example, the codebook configuration parameters for the subframes can be encoded in a Huffman code using Huffman coding. The Huffman code can be sent to a decoder which can identify the one or more configuration codebook parameters from the Huffman codeword. The configuration parameters describe the number of bits used in an adaptive codebook and the number of bits used in a fixed codebook for decoding.

For example, the method can include the steps of receiving at least one parameter related to a codebook configuration, coding the codebook configuration to produce a variable length codeword, and conveying the variable length codeword to a decoder for interpreting the codebook parameter and reconstructing an estimate of the input signal. The one or more codebook configuration parameters corresponding to one or more subframes of a speech frame can be encoded in a variable length codeword. Each codebook parameter can identify an adaptive codebook having a first distribution of bits and a fixed codebook having a second distribution of bits.

Accordingly, a method for decoding parameters for use in reconstructing an estimate of an encoder input signal is provided. The method can include receiving a variable length codeword representing a codebook configuration parameter, receiving a first code related to an adaptive codebook, receiving a second code related to a fixed codebook, decoding the codes related to the adaptive codebook and the fixed codebook based on the codebook configuration parameter, and generating an estimate of the encoder input signal from the adaptive codebook and fixed codebook.

Another embodiment of the invention is a method for analysis-by-synthesis encoding of an information signal. The method can include the steps of generating a weighted reference signal based on the information signal, generating multiple synthetic signals using multiple pitch related codebooks, determining a performance metric based on the reference signal and the first synthetic signal, selecting at least one codebook configuration parameter based on the performance metric, generating a second synthetic signal using a second pitch related codebook, encoding the at least one codebook configuration parameter in a variable length codeword, and conveying the variable length codeword for use in reconstructing an estimate of the input signal.

Referring to FIG. 1, a block diagram of a CELP encoder 100 of the prior art is shown. In CELP encoder 100, an input signal s(n) is applied to a Linear Predictive Coding (LPC) analysis block 101, where linear predictive coding is used to estimate a short-term spectral envelope. The resulting spectral parameters (or LP parameters) are denoted by the transfer function A(z). The spectral parameters are applied to an LPC Quantization block 102 that quantizes the spectral parameters to produce quantized spectral parameters $A_q$ that are suitable for use in a multiplexer 108. The quantized spectral parameters $A_q$ are then conveyed to multiplexer 108, and the multiplexer produces a coded bit-stream based on the quantized spectral parameters and a set of codebook-related parameters τ, β, k, and γ, that are determined by a squared error minimization/parameter quantization block 107.

The quantized spectral, or LP, parameters are also conveyed locally to an LPC synthesis filter 105 that has a corresponding transfer function $1/A_q(Z)$. LPC synthesis filter 105 also receives a combined excitation signal u(n) from a first combiner 110 and produces an estimate of the input signal ŝ(n) based on the quantized spectral parameters $A_q$ and the combined excitation signal u(n). Combined excitation signal u(n) is produced as follows. An adaptive codebook code-vector $c_\tau$ is selected from an adaptive codebook (ACB) 103 based on an index parameter τ. The adaptive codebook code-vector $c_\tau$ is then weighted based on a gain parameter β 109 and the weighted adaptive codebook code-vector is conveyed to first combiner 110. A fixed codebook code-vector $c_k$ is selected from a fixed codebook (FCB) 104 based on an index parameter k. The fixed codebook code-vector $c_k$ is then weighted based on a gain parameter γ 108 and is also conveyed to first combiner 110. First combiner 110 then produces combined excitation signal u(n) by combining the weighted version of adaptive codebook code-vector $c_\tau$ with the weighted version of fixed codebook code-vector $c_k$. Contents of the ACB 103 are then updated using a delayed version of signal u(n) by subframe length L.

LPC synthesis filter 105 conveys the input signal estimate ŝ(n) to a second combiner 112. Second combiner 112 also receives input signal s(n) and subtracts the estimate of the input signal ŝ(n) from the input signal s(n). The difference between input signal s(n) and input signal estimate ŝ(n) is applied to a perceptual error weighting filter 106, which filter produces a perceptually weighted error signal e(n) based on the difference between ŝ(n) and s(n) and a weighting function W(z). Perceptually weighted error signal e(n) is then conveyed to squared error minimization/parameter quantization block 107. Squared error minimization/parameter quantization block 107 uses the error signal e(n) to determine an optimal set of codebook-related parameters τ, β, k, and γ that produce the best estimate ŝ(n) of the input signal s(n).

Figure 2:
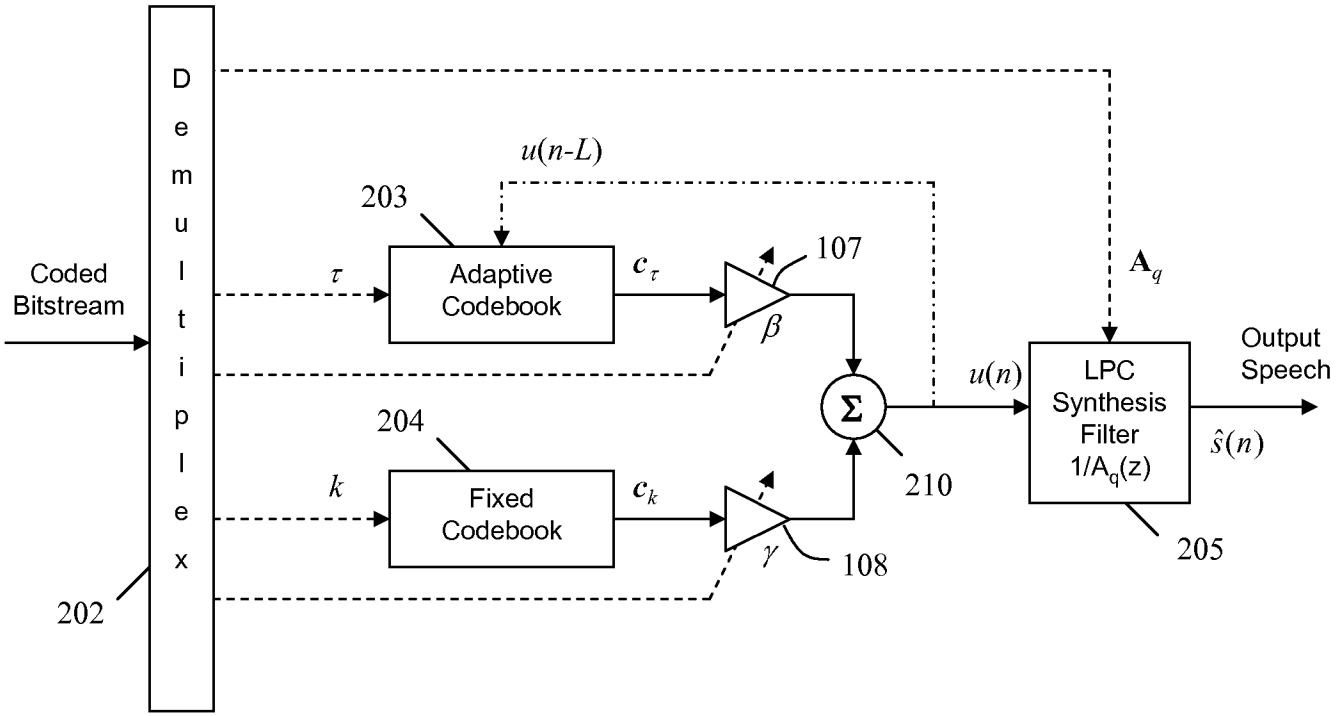
FIG. 2 is a block diagram of a CELP decoder of the prior art.

FIG. 2 generally depicts a Code Excited Linear Prediction (CELP) decoder 200 as is known in the art. As shown in FIG. 2, the excitation sequence or "codevector" $c_k$, is generated from a fixed codebook 204 (FCB) using the appropriate codebook index k. This signal is scaled using the FCB gain factor γ 208 to produce a first synthetic signal. A codevector $c_\tau$ is generated from an adaptive codebook 203 (ACB) and scaled by a factor β 207, which is used to model the long term (or periodic) component of a speech signal (with period τ) to produce a second synthetic signal. The combiner 210 adds the first synthetic signal and the second synthetic signal to produce the total excitation u (n), which is used as the input to the LPC synthesis filter 205, which models the coarse short term spectral shape, commonly referred to as "formants", to produce the output. Additionally, the total excitation signal u (n) is used as the adaptive codebook for the next block of synthesized speech.

The block diagram of decoder 200 of the prior art corresponds to encoder 100. As one of ordinary skilled in the art realizes, the coded bit-stream produced by encoder 100 is used by a demultiplexer 202 in decoder 200 to decode the optimal set of codebook-related parameters, that is, τ, β, k, and γ, in a process that is reverse to the synthesis process performed by encoder 100. Thus, if the coded bit-stream produced by encoder 100 is received by decoder 200 without errors, the speech ŝ(n) output by decoder 200 can be reconstructed as an exact duplicate of the input speech estimate ŝ(n) produced by encoder 100.

Figure 3:
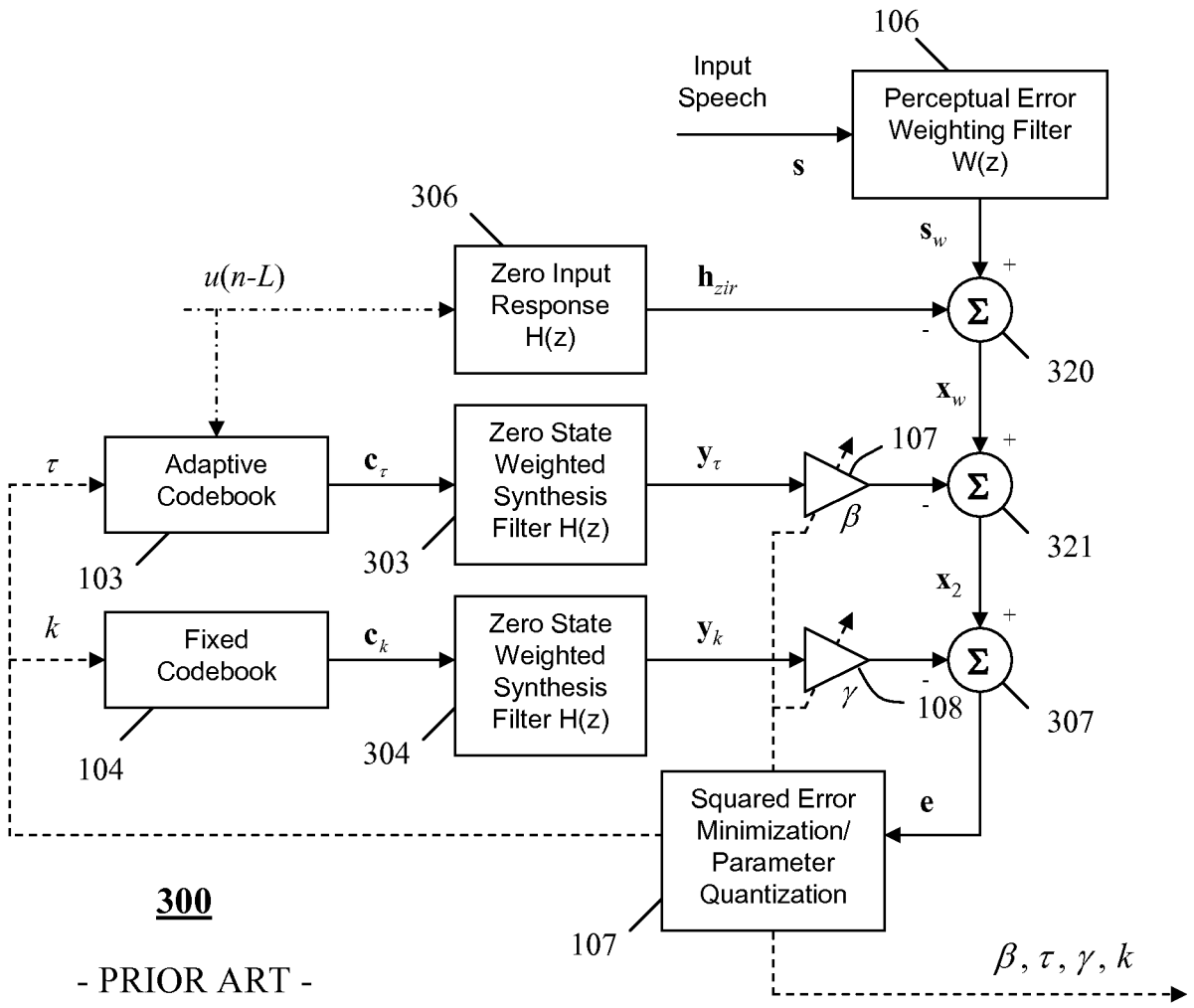
FIG. 3 is a block diagram of another CELP encoder of the prior art.

While CELP encoder 100 is conceptually useful, it is not a practical implementation of an encoder where it is desirable to keep computational complexity as low as possible. As a result, FIG. 3 is a block diagram of an exemplary encoder 300 of the prior art that utilizes a nearly equivalent, and yet more practical, system to the encoding system illustrated by encoder 100. To better understand the relationship between encoder 100 and encoder 300, it is beneficial to look at the mathematical derivation of encoder 300 from encoder 100. For the convenience of the reader, the variables are given in terms of their z-transforms.

From FIG. 1, it can be seen that perceptual error weighting filter 106 produces the weighted error signal e(n) based on a weighted difference between the input signal and the estimated input signal, that is:

$$E(z)=W(z)(S(z)-\hat{S}(z)). \tag{1}$$

From this expression, the weighting function W(z) can be distributed and the input signal estimate ŝ(n) can be decomposed into the filtered sum of the weighted codebook code-vectors:

$$E(z) = W(z)S(z) - \frac{W(z)}{A_q(z)}(\beta C_\tau(z) + \gamma C_k(z)). \tag{2}$$

The term W(z)S(z) corresponds to a weighted version of the input signal. By letting the weighted input signal W(z)S(z) be defined as $S_w(z)=W(z)S(z)$ and by further letting synthesis filter 105 of encoder 100 now be defined by a transfer function $H(z)=W(z)/A_q(z)$, Equation 2 can rewritten as follows:

$$E(z)=S_w(z)-H(z)(\beta C_\tau(z)+\gamma C_k(z)). \tag{3}$$

By using z-transform notation, the filter states need not be explicitly defined. Now proceeding using vector notation, where the vector length L is a length of a current subframe, Equation 3 can be rewritten as follows by using the superposition principle:

$$e=s_w-H(\beta c_\tau+\gamma c_k)-h_{zir}, \tag{4}$$

where:

H is the L×L zero-state weighted synthesis convolution matrix formed from an impulse response of a weighted synthesis filter h(n), such as synthesis filters 303 and 304, and corresponding to a transfer function $H_{zs}(z)$ or H(z), which matrix can be represented as:

$$H = \begin{bmatrix} h(0) & 0 & \dots & 0 \\ h(1) & h(0) & \dots & 0 \\ \vdots & \vdots & \ddots & \vdots \\ h(L-1) & h(L-2) & \dots & h(0) \end{bmatrix}, \tag{5}$$

$h_{zir}$ is a L×1 zero-input response of H(z) 306 that is due to a state from a previous input, $s_w$ is the L×1 perceptually weighted input signal, β is the scalar adaptive codebook (ACB) gain, $c_\tau$ is the L×1 ACB code-vector in response to index τ, γ is the scalar fixed codebook (FCB) gain, and $c_k$ is the L×1 FCB code-vector in response to index k.

By distributing H, and letting the input target vector $x_w=s_w-h_{zir}$, the following expression can be obtained:

$$e=x_w-\beta Hc_\tau-\gamma Hc_k. \tag{6}$$

Equation 6 represents the perceptually weighted error (or distortion) vector e(n) produced by a third combiner 307 of encoder 300 and coupled by combiner 307 to a squared error minimization/parameter block 107.

From the expression above, a formula can be derived for minimization of a weighted version of the perceptually weighted error, that is, $\|e\|^2$, by squared error minimization/parameter block 107. A norm of the squared error is given as:

$$\epsilon=\|e\|^2=\|x_w-\beta Hc_\tau-\gamma Hc_k\|^2. \tag{7}$$

Due to complexity limitations, practical implementations of speech coding systems typically minimize the squared error in a sequential fashion. That is, the ACB component may be optimized first (by assuming the FCB contribution is zero), and then the FCB component is optimized using the given (previously optimized) ACB component. The ACB/FCB gains, that is, codebook-related parameters β and γ, may or may not be re-optimized, that is, quantized, given the sequentially selected ACB/FCB code-vectors $c_\tau$ and $c_k$.

The theory for performing the sequential search is as follows. First, the norm of the squared error as provided in Equation 7 is modified by setting γ=0, and then expanded to produce:

$$\epsilon=\|x_w-\beta Hc_\tau\|^2=x_w^Tx_w-2\beta x_w^THc_\tau+\beta^2c_\tau^TH^THc_\tau. \tag{8}$$

Minimization of the squared error is then determined by taking the partial derivative of ε with respect to β and setting the quantity to zero:

$$\frac{\partial\varepsilon}{\partial\beta} = x_w^THc_\tau - \beta c_\tau^TH^THc_\tau = 0. \tag{9}$$

This yields the optimal ACB gain:

$$\beta = \frac{x_w^THc_\tau}{c_\tau^TH^THc_\tau}. \tag{10}$$

Substituting the optimal ACB gain back into Equation 8 gives:

$$\tau^* = \arg\min_\tau\left\{x_w^Tx_w - \frac{(x_w^THc_\tau)^2}{c_\tau^TH^THc_\tau}\right\}, \tag{11}$$

where τ* is an optimal ACB index parameter, that is, an ACB index parameter that minimizes the value of the bracketed expression. Since $x_w$ is not dependent on τ, Equation 11 can be rewritten as follows:

$$\tau^* = \arg\max_\tau\left\{\frac{(x_w^THc_\tau)^2}{c_\tau^TH^THc_\tau}\right\}. \tag{12}$$

Now, by letting $y_\tau$ equal the ACB code-vector $c_\tau$ filtered by weighted synthesis filter 303, that is, $y_\tau=Hc_\tau$, Equation 13 can be simplified to:

$$\tau^* = \arg\max_\tau\left\{\frac{(x_w^Ty_\tau)^2}{y_\tau^Ty_\tau}\right\}, \tag{13}$$

and likewise, Equation 10 can be simplified to:

$$\beta = \frac{x_w^Ty_\tau}{y_\tau^Ty_\tau}. \tag{14}$$

Thus Equations 13 and 14 represent the two expressions necessary to determine the optimal ACB index τ and ACB gain β in a sequential manner. These expressions can now be used to determine the sequentially optimal FCB index and gain expressions. First, from FIG. 3, it can be seen that a second combiner 321 produces a vector $x_2$, where $x_2=x_w-\beta Hc_\tau$. The vector $x_w$ is produced by a first combiner 320 that subtracts a past excitation signal u(n−L), after filtering by a zero input response filter 306, from an output $s_w(n)$ of a perceptual error weighting filter 310. The term $\beta Hc_\tau$ is a filtered and weighted version of ACB code-vector $c_\tau$, that is, ACB code-vector $c_\tau$ filtered by weighted synthesis filter 303 and then weighted based on ACB gain parameter β. Substituting the expression $x_2=x_w-\beta Hc_\tau$ into Equation 7 yields:

$$\epsilon=\|x_2-\gamma Hc_k\|^2. \tag{15}$$

where $\gamma Hc_k$ is a filtered and weighted version of FCB code-vector $c_k$, that is, FCB code-vector $c_k$ filtered by weighted synthesis filter 304 and then weighted based on FCB gain parameter γ. Similar to the above derivation of the optimal ACB index parameter τ* it is apparent that:

$$k^* = \arg\max_k\left\{\frac{(x_2^T Hc_k)^2}{c_k^T H^T Hc_k}\right\}, \tag{16}$$

where k* is a sequentially optimal FCB index parameter, that is, an FCB index parameter that maximizes the value in the bracketed expression. By grouping terms that are not dependent on k, that is, by letting $d_2^T=x_2^T H$ and $\Phi=H^T H$, Equation 16 can be simplified to:

$$k^* = \arg\max_k\left\{\frac{(d_2^T c_k)^2}{c_k^T \Phi c_k}\right\}, \tag{17}$$

in which the sequentially optimal FCB gain γ is given as:

$$\gamma = \frac{d_2^T c_k}{c_k^T \Phi c_k}. \tag{18}$$

Thus, encoder 300 provides a method and apparatus for determining the optimal excitation vector-related parameters τ, β, k, and γ, in a sequential manner. However, the sequential determination of parameters τ, β, k, and γ is actually sub-optimal since the optimization equations do not consider the effects that the selection of one codebook code-vector has on the selection of the other codebook code-vector.

Figure 4:
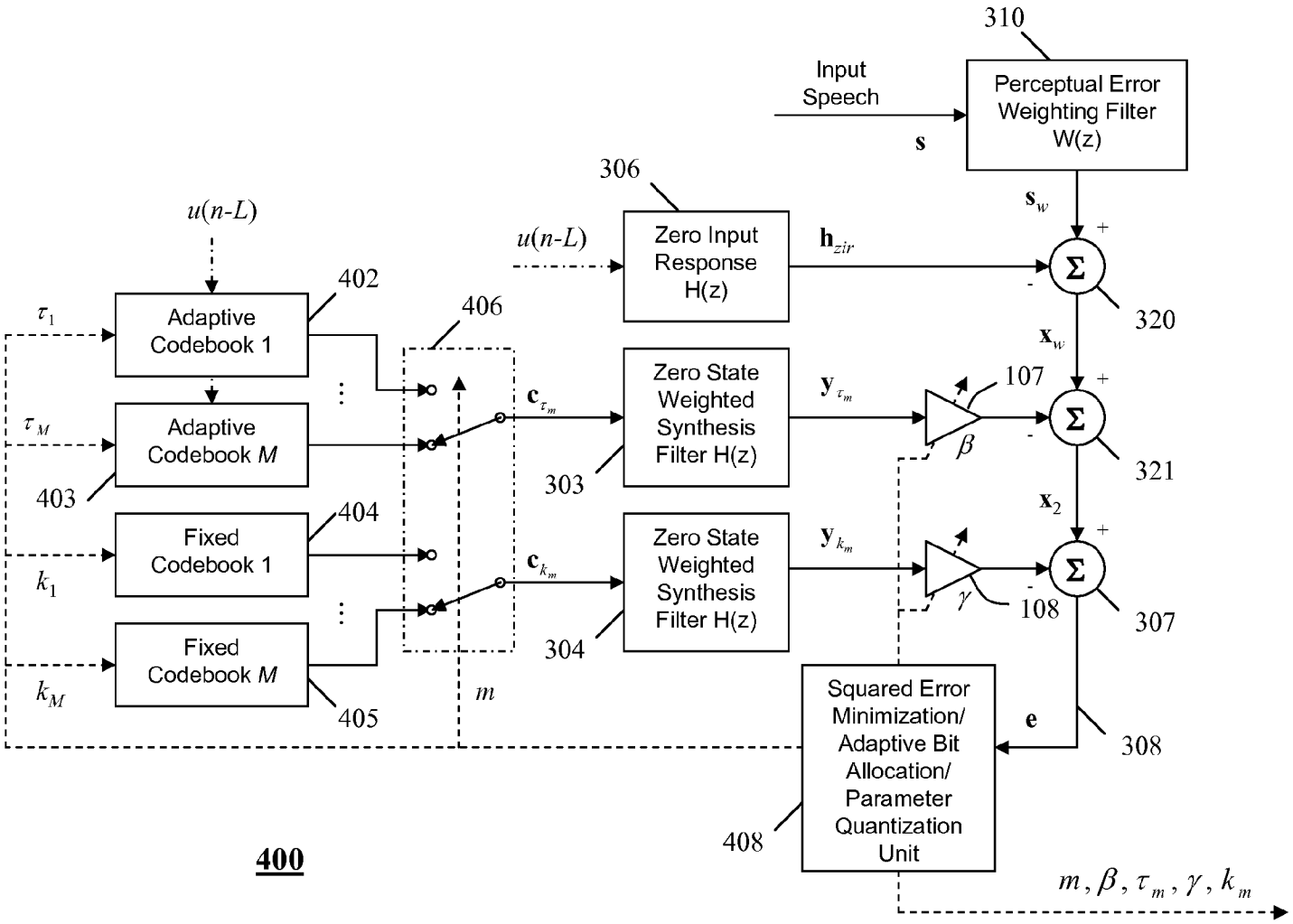
FIG. 4 is a block diagram of a CELP encoder in accordance with an embodiment of the present invention.

Embodiments in accordance with the present invention may be more fully described with reference to FIGS. 4-7. FIG. 4 is a block diagram of a Code Excited Linear Prediction (CELP) encoder 400 that implements an analysis-by-synthesis coding process in accordance with an embodiment of the present invention. Encoder 400 is implemented in a processor, such as one or more microprocessors, microcontrollers, digital signal processors (DSPs), combinations thereof or such other devices known to those having ordinary skill in the art, that is in communication with one or more associated memory devices, such as random access memory (RAM), dynamic random access memory (DRAM), and/or read only memory (ROM) or equivalents thereof, that store data and programs that may be executed by the processor.

As can be seen in FIG. 4, encoder 400 employs multiple Adaptive Codebooks 402, 403 and multiple Fixed Codebooks 404, 405 and also Squared Error Minimization/Adaptive Bit Allocation/Parameter Quantization Unit 408. Coupled to the multiple Adaptive and Fixed codebooks is a double-pole, multi-throw (DPMT) switch 406 that functions to select various complementary sets of Adaptive and Fixed Codebook contributions. The DPMT switch 406 is not limited to hardware, and can be a software configurable switch selectable by the error minimization/adaptive bit allocation unit 408. The primary difference in the M sets of ACB and FCB codebooks is the respective bit allocation definitions. The bit allocation definitions describe the number of bits allotted to each codebook.

The ACB/FCB configuration parameter m (1≤m≤M) selects a combination of ACB/FCB that trades off bit allocation and bit rate based on the error minimization unit 408. For example, the error minimization/adaptive bit allocation unit 408 can determine a configuration, m, that provides a compromise between the bits allocated to the ACB and the bits allocated to the FCB for providing an optimal combination of encoding the input speech signal, s. The configuration parameter, m, identifies the ACB and FCB codebooks that are to be employed during encoding. Notably, the configuration parameter, m, can change during the encoding process for accurately modeling the input speech signal.

In general, the phonetic content of speech can vary such that differing contributions of the codebook can be warranted. For example, speech can be composed of voiced and unvoiced portions. The contributions of the unvoiced portions and voiced portions can change over time. Whereas consonants are typical of unvoiced speech and having a more abrupt nature, vowels are typical of voiced speech and having a more periodic nature. Unvoiced speech and speech onsets can rely heavily on the FCB contribution, while periodic signals such as steady state voiced speech can rely heavily on the ACB contribution. As another example, transition voiced speech can rely on a more balanced contribution from both the ACB and FCB. Thus, an embodiment of the present invention selects an ACB/FCB configuration m that optimizes the allocation of bits to the respective ACB/FCB contributions to balance the contribution of the ACB codebook and the FCB codebooks based on the content of speech for accurately modeling speech. In practice, the error minimization/bit allocation unit 408 determines the bit allocations that result in a minimum error, e, to produce the best estimate ŝ(n) of the input signal s(n)

In the current invention, the derivation of the error expression is modified from that in the prior art as follows. In general terms, Equation 13 may be modified to take the form:

$$\tau_m^* = \arg\max_{\tau_m}\left\{\frac{(x_w^T y_{\tau_m})^2}{y_{\tau_m}^T y_{\tau_m}}\right\}, \tag{19}$$

where $\tau_m$ is the ACB codevector associated with the $m^{th}$ ACB, and $\tau_m$* is the optimal ACB index parameter for ACB m. From this expression, it may be possible to then select an ACB/FCB configuration using the expression:

$$m=arg\max\{\epsilon_1', \ldots, \epsilon_M'\}, \tag{20}$$

where $\epsilon_m'$ is a form of the error expression which corresponds to:

$$\varepsilon_m' = \frac{(x_w^T y_{\tau_m^*})^2}{y_{\tau_m^*}^T y_{\tau_m^*}}. \tag{21}$$

where $y_{\tau_m}$*, is the filtered ACB vector resulting from the optimal ACB parameter of codebook m, that is $\tau_m$*. The ACB/FCB configuration m may be selected based on the maximum value of the parameter $\epsilon_m'$ which corresponds to the filtered ACB codevector $y_{\tau_m}*$, that produces the minimum squared error. Notably, maximizing the error expression $\tau_m'$ corresponds to minimizing the error, e.

For example, referring to FIG. 4, the first ACB codebooks 402 is evaluated to determine which of the codevectors, $\tau_1$, in the first ACB codebook produces the smallest error. The codevector that produces the smallest error is considered the optimal codevector for the first codebook, $\tau_1*$. Similarly, the second ACB codebook 402 is evaluated to determine which of the codevectors, $\tau_2$, in the ACB codebook produces the smallest error. The code vector that produces the smallest error is considered the optimal codevector for the second codebook, $\tau_2*$. Each of the M codebooks is evaluated for the codevector that produces the smallest error, $\tau_m*$. Accordingly, each codebook will have an optimal codevector that produces the minimum error for that codebook.

Each of the codevectors in a first codebook can be represented by a certain number of bits, for example N bits. Moreover, each of the codevectors in the second codebook can be represented by a certain number of bits that is more than the number of bits in the preceding codebook, for example N+B bits. Similarly, the number of bits used to represent the codevectors in each codebook 1 to M can increase with each codebook to increase the codevector resolution. Increasing the bits can increase the modeling resolution of the codevectors. Notably, the set of codevectors in one codebook differs from a set of codevectors in another codebook by the number of bits assigned to the codevectors in the codebook.

For example, the first codebook, ACB 1 (402), may allocate 4 bits for the codevectors in that codebook. The second codebook ACB 2, may allocate 8 bits for the codevectors in that codebook. Understandably, increasing the number of bits can improve the modeling performance for certain portions of speech. For example, an adaptive codebook having codevectors with a high number of bits may accurately model voiced speech. However, a fixed codebook may not require that same number of bits to represent the voiced speech. In contrast, a fixed codebook having codevectors with a high number of bits may accurately model unvoiced speech. However, an adaptive codebook may not require that same number of bits to represent the unvoiced speech. Accordingly, the number of bits allocated to the codevectors of the codebooks can be disproportionately assigned to take advantage of the changing nature of speech.

Referring again to FIG. 4, an initial first excitation vector $c_{\tau m}$, is generated by an adaptive codebook 402 based on an excitation vector-related parameter $\tau_m$ sourced to the mth adaptive codebook by the error minimization unit 408. In one embodiment of the present invention, adaptive codebook 1 (m=1) 402 is a virtual codebook that stores multiple vectors and parameter $\tau_m$ is an index parameter that corresponds to a vector of the multiple vectors stored in the codebook. In such an embodiment, $c_{\tau_1}$ is an adaptive codebook (ACB) codevector. In another embodiment of the present invention, adaptive codebook 402 is a long-term predictor (LTP) filter and parameter $\tau_m$ is a lag corresponding to a selection of a past excitation signal u(n−L) for the mth adaptive codebook; that is, the adaptive codebook is a pitch related codebook.

The initial first excitation vector $c_{\tau m}$ is conveyed to a first zero state weighted synthesis filter 303 that has a corresponding transfer function $H_{zs}(z)$, or in matrix notation H. Weighted synthesis filter 303 filters the initial first excitation vector $c_{\tau m}$ to produce a signal $y_{\tau m}$ (n) or, in vector notation, a vector $y_{\tau m}$, wherein $y_{\tau m}=Hc_{\tau m}$ The filtered initial first excitation vector $y_{\tau m}$, is then weighted by a first gain 109 based on an initial first excitation vector-related gain parameter β and the weighted, filtered initial first excitation vector, $\beta Hc_{\tau m}$, or first synthetic signal $\beta y_{\tau m}$, is conveyed to second combiner 321

Second combiner 321 subtracts the weighted, filtered initial first excitation vector $\beta Hc_{\tau m}$, or first synthetic signal $\beta y_{\tau m}$, from the target input signal or vector $x_w$ to produce an intermediate signal $x_2(n)$, or in vector notation an intermediate vector $x_2$, wherein $x_2=x_w-\beta Hc_{\tau m}$. Second combiner 321 then conveys intermediate signal $x_2$ (n), or vector $x_2$, to a third combiner 307. Third combiner 307 also receives a weighted, filtered version of an initial second excitation vector $c_{km}$ preferably a fixed codebook (FCB) code-vector. The initial second excitation vector $c_{km}$, is generated by a fixed codebook 404, preferably a fixed codebook (FCB), based on an initial second excitation vector-related index parameter k, preferably an FCB index parameter. The initial second excitation vector $c_{km}$ is conveyed to a second zero state weighted synthesis filter 304 that also has a corresponding transfer function $H_{zs}(z)$, or in matrix notation H. Weighted synthesis filter 304 filters the initial second excitation vector $c_{km}$ to produce a signal $y_{km}$ (n), or in vector notation a vector $y_{km}$, where $y_{km}=Hc_{km}$. The filtered initial second excitation vector $y_{km}$ (n), or $y_{km}$, is then weighted by a second gain 108 based on an initial second excitation vector-related gain parameter γ. The weighted, filtered initial second excitation vector $Hc_{km}$, or signal $y_{km}$, is then also conveyed to third combiner 307.

Third combiner 307 subtracts the weighted, filtered initial second excitation vector $\gamma Hc_{km}$, or signal $y_{km}$ from the intermediate signal $x_2(n)$, or intermediate vector $x_2$, to produce a perceptually weighted error signal e(n), or e. Perceptually weighted error signal e(n) is then conveyed to the error minimization unit 408, preferably a squared error minimization/parameter quantization block that includes adaptive bit allocation. Notably, the error minimization unit 408 can adjust the gain elements β and γ to minimize the perceptually weighted error signal, or mean squared error criterion, e(n). Error minimization/bit allocation/parameter quantization unit 408 uses the error signal e(n) to jointly determine multiple excitation vector-related parameters τ, β, k and γ that optimize the performance of encoder 400 by minimizing a squared sum of the error signal e(n) 308. The optimization includes identifying the bit-allocations for the ACB and FCB that produce the optimal first and second excitation vectors. Thus, optimization of index parameters τ and k, that is, a determination of τ* and k*, with regard to the M bit-allocated codebooks respectively results in a generation (526) of the optimal first excitation vector $c_{\tau m}*$ by the adaptive codebook 402, and the optimal second excitation vector $c_{km}*$ by the fixed codebook 403. Optimization of parameters β and γ, with regard to the M bit-allocated codebooks, respectively results in optimal weightings of the filtered versions of the optimal excitation vectors $c_{\tau m}*$ and $c_{km}*$, thereby producing a best estimate of the input signal s(n).

Unlike squared error minimization/parameter block 408 of encoder 300, which determines an optimal set of multiple codebook-related parameters τ, β, k and γ by performing a sequential optimization process, error minimization unit 408 of encoder 400 determines the optimal set of excitation vector-related parameters $\tau_m$, β, $k_m$ and γ by evaluating M codebook bit allocations and gain scalings that are non-sequential. By performing a bit allocation and gain scaling process during error minimization, a determination of excitation vector-related parameters $\tau_m$, β, $k_m$ and γ can be optimized that are interdependent among one another. That is, the effects of the selection of one excitation vector has on the selection of the other excitation vector is taken into consideration in the optimization of each parameter.

In particular, the parameters $\tau_m$, $\beta$, $k_m$ and $\gamma$ are dependent on the bit-allocations for each of the M codebook configurations. The various bit-allocations produce excitation vectors $c_{\tau m}$* and $c_{km}$* having resolutions dependent on the allocated number of bits to the codebook. Understandably, certain portions of speech may require more or less bits from the ACB and FCB codebooks for accurately modeling the speech. Error minimization/bit allocation/parameter quantization unit 408 can identify the optimal bit-allocations for producing the best estimate of speech.

The optimization process identifies the bit-allocations for the adaptive codebook and the bit-allocations for the fixed codebook that together produce the best estimate of the input signal s(n). Error minimization/adaptive bit allocation/parameter quantization unit 408 selects a codebook configuration parameter, m, based on a first and a second performance metric. The codebook configuration parameter, m, in effect, identifies a first distribution of bits for a first adaptive (pitch-related) codebook and a second distribution of bits for a second adaptive (pitch-related) codebook. The configuration parameter, m, identifies the codebook which corresponds to a particular bit-allocation. For example, Error minimization/adaptive bit allocation/parameter quantization unit 408 can identify a distribution of bits (a codebook configuration m) for adaptive codebook 402 through 403 and fixed codebook 404 through 405 that minimizes the power of the weighted error signal e(n). Error minimization/adaptive bit allocation/parameter quantization unit 408 can identify a bit-allocation that results in the minimum closed loop analysis-by-synthesis error.

Figure 5:
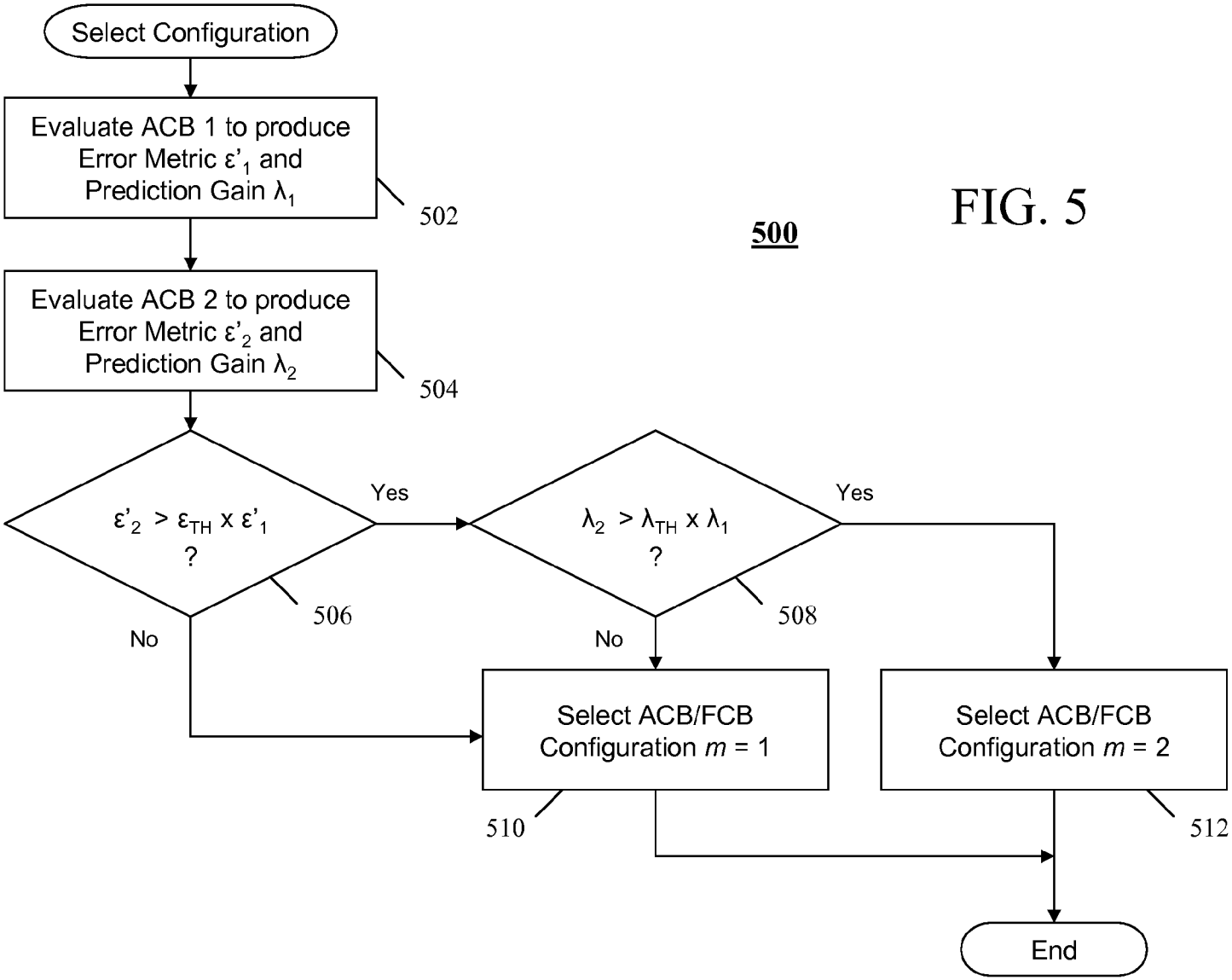
FIG. 5 is a logic flow diagram of steps executed by the CELP encoder of FIG. 4 in coding a signal in accordance with an embodiment of the present invention.

Referring, to FIG. 5 an exemplary configuration selection process is shown. At step 501, a configuration can be selected. For example, configuration m=1 can be selected. Configuration m=1 can correspond to N ACB bits and configuration m=2 can correspond to N+B ACB bits. At step 502, a first adaptive codebook, ACB 1, can be evaluated to produce a first performance metric (weighted error) $\tau_1'$ and a second performance metric (prediction gain) $\lambda_1$ in accordance with the operational aspects of the invention described in FIG. 4. For example, all codevectors in the N bit ACB1 codebook can be evaluated for minimizing the mean square error, e, of FIG. 4. Accordingly, the metric $\epsilon_1'$ and the prediction gain $\lambda_1$ that achieves the minimum error can be determined. At step 504, a second codebook, ACB 2, can be evaluated to produce error metric $\epsilon_2'$ and prediction gain $\lambda_2$ in accordance with the operational aspects of the invention described in FIG. 4. The evaluation of the second codebook ACB 2 can correspond to configuration m=2. Understandably, an evaluation between m=1 and m=2 is conducted to determine the distribution of bits in the adaptive codebook that achieves the best performance. At step 506, the respective error metrics $\epsilon_1'$ and $\epsilon_2'$ can be compared. In particular, the comparison includes an error bias, $\epsilon_{TH}$, to ensure that if the comparison yields a numerically positive result, then $\epsilon_2'$ is significantly greater than $\epsilon_1'$, and configuration m=1 can be selected if $\epsilon_2'>\epsilon_1'\Delta\epsilon_{TH}$. Else configuration m=2 can be tentatively selected. At step 508, a secondary check on the relative ACB performance can ensure that noise or other potentially anomalies do not contribute to a false positive. Accordingly, a second comparison of prediction gains $\lambda_1$ and $\lambda_2$ determines if the prediction gain of ACB 2 is significantly greater than the prediction gain of ACB 1. Configuration m=2 can be chosen if the long-term prediction gain $\lambda_2$ is also greater than $\lambda_1$ by at least a gain bias of $\lambda_{TH}$. If the error expression comparison and the prediction gain comparison are not true, then configuration m=1 is chosen.

The error minimization unit/adaptive bit allocation unit 408 generates and evaluates the error metrics and the prediction gains for selecting the codebook configuration. For example, a first configuration can be evaluated against a second configuration, and the second configuration can be selected if the performance metrics of the second configuration exceed the first configuration with respect to the error bias and the prediction gain bias. The flowchart 500 describes the methods steps for a configuration m=2. however, the evaluation can continue if more than two configurations are provided. Understandably, the method can be extended to multiple codebook configurations. For instance, if the second configuration is selected over the first configuration, a third configuration can be evaluated against the second configuration. In practice, the codebook configuration evaluation ceases when a new configuration does not exceed the performance metrics of a current configuration. For example, if the third configuration does not exceed the second configuration, a fourth and fifth configurations will not be evaluated since the third configuration did not exceed the performance metrics of the second configuration, even if m=5 configurations are available.

In summary, the error minimization/adaptive bit allocation/parameter quantization unit 408 assesses the performance modeling errors for each of the ACB and FCB codebooks and identifies the bit-allocation for these codebooks that provide the least error; that is, the contribution of each codebook that provides the highest modeling performance. For example, the error minimization/adaptive bit allocation/parameter quantization unit 408 evaluates each of the m ACB codebooks to determine the list of m codevectors, $\tau_m$, producing the smallest error. The Error minimization unit 408 selects the codebook having the codevector producing the smallest error. The Error minimization/adaptive bit allocation/parameter quantization unit 408 (herein after error minimization unit) also evaluates each of the m FCB codebooks, $k_m$, to determine the list of m codevectors producing the smallest error. The Error minimization unit 408 selects the codebook having the codevector producing the smallest error; that is, the codebook that corresponds to the maximum value of the parameter $\epsilon_m'$ in EQ (12)

Upon determining a codebook configuration based on the evaluation of error performance metrics and prediction gain metrics, the codevectors and codebook gains can be determined. For example, upon determining m=2, the multiple codebook-related parameters $\tau$, $\beta$, k and $\gamma$ for m=2 can be determined by the methods used in the sequential optimization process presented in discussion of FIG. 3. Notably, the flowchart 500 determines the codebook configuration for the adaptive and fixed codebook. Once the codebook configuration is selected, the multiple codebook-related parameters $\tau$, $\beta$, k and $\gamma$ can be determined in the manner described with FIG. 3.

In the aforementioned embodiment, each of the codebooks are assigned a different number of bits to represent the codevectors in the codebook. The number of bits assigned to each codebook are fixed, and the number of adaptive and fixed codebooks are fixed. The Error minimization unit 408 identifies the codebook configuration providing the optimal bit-allocation prior to a determination of the multiple codebook related parameters $\tau$, $\beta$, k and $\gamma$. Alternatively, in another embodiment of the invention, bits can be allocated dynamically (adaptively) to the codevectors during an encoding. Namely, the error minimization unit 408 can increase or decrease the number of bits in a codebook for one or more codevectors to maximize a performance metric. For example, bits can be allocated between the adaptive codebook 402 and the fixed codebook 404 to increase or decrease the codevector resolution in order to minimize the error criterion, e 308. The Error minimization unit 408 can dynamically allocate the bits in a non-sequential order based on the first and second performance metric. That is, the bit allocations for the adaptive codebook and the fixed codebooks can occur dynamically within the same codebook. In practice, Error minimization unit 408 identifies a configuration, m, for a codebook which provides an optimal compromise between the quality of the first synthetic signals generated by the ACB and the quality of the second synthetic signals generated by the FCB. The optimal configuration produces the minimum error. The configuration can identify the number of bits assigned to the adaptive codebook and the number of bits assigned to the fixed codebook.

For example, Table 1 shows two bit assignment configurations available for an encoding implementation having two codebooks, ACB and FCB. The first configuration, m=1, reveals that 0 bits are assigned to the adaptive codebook, and 31 bits are assigned to the fixed codebook. The second configuration, m=2, reveals that 4 bits are assigned to the adaptive codebook, and 27 bits are assigned to the fixed codebook. The number of bits allocated is not limited to those shown in Table 1, which are provided only as example. In practice, the configurations can be stored in a data memory and accessed by the Error minimization unit/Adaptive Bit Allocation unit 408. In this exemplary table, the total number of bits available to both the codebooks is 32. Notably, a configuration identifies the allocation of bits to each of the codebooks. Those who are of ordinary skill in the art realize that the arrangement of the codebooks and their respective codevectors may be varied without departing from the spirit and scope of the present invention. Embodiments of the invention are not limited to only two codebooks, and more than two codebooks are herein contemplated. For example, the first codebook may be a fixed codebook, the second codebook may be an adaptive codebook.

In another aspect, the dynamic bit-allocation strategy of the invention can be applied to Factorial Pulse Coding. For example, In the IS-127 half rate case (4.0 kbps), the FCB uses a multi-pulse configuration in which the excitation vector $c_k$ contains only three non-zero values. Since there are very few non-zero elements within $c_k$, the computational complexity involved with EQ (18) is relatively low. For the three "pulses," there are only 10 bits allocated for the pulse positions and associated signs for each of the three subframes (of length of L=53, 53, 54). In this configuration, an associated "track" defines the allowable positions for each of the three pulses within $c_k$ (3 bits per pulse plus I bit for composite sign of +, −, + or −, +, −). As shown in Table 4.5.7.4-1 of IS-127, pulse 1 can occupy positions 0, 7, 14, . . . , 49, pulse 2 can occupy positions 2, 9, 16, . . . , 51, and pulse 3 can occupy positions 4, 11, 18, . . . , 53. This is known as "interleaved pulse permutation," which is well known in the art.

However, the excitation codevector $c_k$ is not generally robust enough to model different phonetic aspects of the input speech. The primary reason for this is that there are too few pulses which are constrained to too small a vector space. Each pulse takes a certain number of bits, for example, 4 bits per pulse. Accordingly, embodiments of the invention can assign more or less bits to the FCB for increasing or decreasing the number of pulses to adequately represent certain portions of speech. Similarly, the number of pulses can be decreased for certain portions of speech, and the bits used for the pulse in the FCB can be applied to the codevectors of the ACB. In this manner, bits can be allocated between the ACB and the FCB for producing codebook configurations optimized for certain types of speech that are encoded using factorial packing.

For example, referring again to FIG. 4, a single ACB 402 and a single FCB 404 can be selected in which bits can be allocated to the two codebooks. In one arrangement, ACB 402 can be a Delay Contour Adjustment ACB, as described in commonly assigned U.S. patent application Ser. No. 6,236,960, and the FCB 404 can be a Factorial Pulse Codebook (FPC) for the FCB as described in U.S. Pat. No. 6,236,960 (although any ACB/FCB structures may be used). The configurations of Table 1 be applied to the ACB 402 and FCB 404. For example, configuration m=1, corresponds with a configuration of ACB 402 wherein the default delay contour is used. That is, the number of bits assigned to ACB is zero which sets a delay adjustment parameter to zero ($\Delta_{adj}$=0). The delay adjustment parameter can correspond to a lag term which may be representative of a pitch period. As those skilled in the art can appreciate, the delay contour can correspond to a change in the pitch. For example, the pitch of the speech may slowly vary over time during monotone activity, or it may rapidly change over time such as the case during vocal inflections. If the pitch of the voice does not vary, or change, the delay contour can be zero. Accordingly, zero bits will be assigned to the pitch parameter since the pitch information can be retrieved from a previous encoding. The bits designated to the pitch parameter can then be distributed to other parameters of the speech, for example the FCB codevectors. So, for m=1, zero bits are used to describe the ACB codevector shape, and all the bits are assigned to the FCB.

In the m=1 configuration, the FCB uses a 6 pulse FCB, comprising 31 bits for the FPC over a subframe length of 54. Understandably, more pulses can be assigned to represent the codevector of the FCB since the bits to represent these pulses are allocated away from the ACB. As is known to those skilled in the art, the number of pulses used in an FCB can be determined through table look up. For example, a 5 bit pulse corresponds to an index in an FCB table that determines the number of bits assigned to the FCB codeword for representing the 5 bit pulse. The index is equal to the order of the pulse configuration in the total order.

Referring again to Table 1, configuration m=2 reveals that 4 bits are assigned to the ACB delay adjustment parameter, thereby providing a refinement of the ACB shape over the m=1 configuration. Notably, configuration m=2 allocates more bits to the ACB codebook for increasing the resolution of the ACB codevectors. Configuration m=2 can be selected when the pitch of the speech changes such that the delay contour is a value greater than zero. That is, the 4 bits assigned to the ACB allow a value to be assigned to the delay contour. However, these 4 bits reduce the number of bits available for representing the pulses in the Factorial Pulse Codebook. Configuration m=2, reduces the number of pulses from 6 pulses to 5 pulses, thereby reducing the total to 27 bits for the FCB. The total number of bits assigned to both codebooks is a constant for this particular example. That is, the total number of bits for each configuration is the same for each value of m. Those skilled in the art can appreciate the number of bits between the codebooks does not need to remain fixed, and Table 1, is only an exemplary embodiment illustrating the principles of dynamic bit allocation between codebooks.

TABLE 1

ACB/FCB Configuration Example

| Configuration m | ACB bits | FCB bits | Total bits |
|---|---|---|---|
| 1 | 0 | 31 | 32 |
| 2 | 4 | 27 | 32 |

The selection of a configuration m can be performed in a manner that dedicates more bits to the ACB in cases where the improvement due to the increased resolution in the ACB parameters exceeds the relative degradation due to the FCB when reducing the number of pulses from 6 to 5. A comprehensive error minimization on all the codevectors of the codebooks can be conducted to determine the optimal bit-allocations. However, such an exhaustive procedure can be computationally demanding, and an alternate, more appropriate, solution can be employed. The lower complexity method uses a biased ACB error minimization process that justifies the reduction of bits in the FCB. In principle, more bits are allocated to the FCB when the performance is significantly greater than that using fewer bits. The performance can be measured with regard to minimizing the error. For example, a bias term (as shown in FIG. 5) can be included during an assessment of the first error metric and gain prediction metric. The bias term reveals the degree of improvement necessary to justify an increased allocation of bits from the fixed codebook to the adaptive codebook. The bias terms determine when the quality of one codebook contribution exceeds the quality by a second codebook contribution. The ACB configuration corresponding to the fewest bits can be evaluated according to the expression:

$$\tau_1^* = \arg\max_{\tau_1}\left\{\frac{(x_w^T y_{\tau_1})^2}{y_{\tau_1}^T y_{\tau_1}}\right\}, \tag{22}$$

to produce an error metric:

$$\varepsilon_1' = \frac{(x_w^T y_{\tau_1^*})^2}{y_{\tau_1^*}^T y_{\tau_1^*}}. \tag{23}$$

Similar processing may then be performed for configuration m=2 to produce an error metric $\epsilon_2'$ corresponding to ACB parameter $\tau_2^*$. The long-term prediction gain may also be calculated to include in the selection of a configuration m, defined as:

$$\lambda_m = \frac{\|x_w\|^2}{\|x_w - y_{\tau_m^*}\|^2}. \tag{24}$$

In another embodiment of the present invention, the methods herein described are applied to subframe encoding. For example, a codebook configuration can be selected for each subframe of a frame of speech. The bits required to represent the coding configuration and the bits required to represent the codebooks can be combined into a single combined codeword. The single combined codeword can take advantage of coding redundancies when combining the bits of the subframes. Accordingly, an efficient coding method can applied to the bits to minimize overhead related to the ACB/FCB configuration information. For example, a Huffman coding scheme can be applied to the bits to achieve higher data compression.

Consider a speech frame containing three subframes wherein 3 bits of information are required to convey the M=2 configurations per subframe to the respective decoding processor. Understandably, a subframe configuration requires a single bit for providing two states, and there are three subframes which require a minimum of 3 bits. However, the configurations can be coded using a variable rate code, such as a Huffman code, to reduce the overhead due to the coding of the M configurations. For example, Table 2 illustrates an exemplary coding configuration using Huffman coding wherein the number of bits varies as a function of the number of pulses per subframe. Table 2 identifies the number of Huffman code, the pulses per subframe, the number of Huffman bits, the allocation of bits between the ACB and FCB, and the total number of bits. In the particular example, the total number of bits is a constant that is the sum of the Huffman code bits, ACB bits, and FCB bits. The notation 6-6-5, under pulses per subframe, describes the number of pulses per subframe for a frame of speech. For example, 6-6-5 states that there are 6 subframes in subframe 1, 6 pulses in subframe 2, and 5 pulses in subframe 3.

Referring to Table 2, Huffman code 0 states that 6 pulses will be used in each of the 3 subframes and that zero bits are allocated to the ACB. In this arrangement, all the bits are assigned to the FCB to represent the pulses. Notably, only 1 Huffman bit is required for the entire frame versus the 3 bits required without variable length coding. In effect, the overhead of coding M=2 configurations per subframe is captured by using only 1 bit for the entire frame for Huffman code 0. In contrast, Huffman code 100 states that 6 pulses are used in the first 2 subframes followed by 5 pulses in the third subframe. The Huffman code bit-length increases as the number of the pulses in the subframes are reduced. Understandably, the proportion of voiced and unvoiced portions in speech is balanced more towards voiced content. That is, most of speech is more voiced than unvoiced. Accordingly, a shorter Huffman code for unvoiced regions of speech provides more coding bits for the FCB, and longer Huffman codes corresponding to voiced speech provides more coding bits to the ACB.

TABLE 2

ACB/FCB Configuration Example over Multiple Subframes

| Huffman Code | Pulses per Subframe | Huffman Bits | ACB Bits | FCB Bits | Total bits |
|---|---|---|---|---|---|
| 0 | 6-6-6 | 1 | 0 | 93 | 94 |
| 100 | 6-6-5 | 3 | 2 | 89 | 94 |
| 101 | 6-5-6 | 3 | 2 | 89 | 94 |
| 110 | 5-6-6 | 3 | 2 | 89 | 94 |
| 11100 | 6-5-5 | 5 | 2 + 2 | 85 | 94 |
| 11101 | 5-6-5 | 5 | 2 + 2 | 85 | 94 |
| 11110 | 5-5-6 | 5 | 2 + 2 | 85 | 94 |
| 11111 | 5-5-5 | 5 | 2 + 2 + 2 | 81 | 92 |

For subframes with 5 pulses, the corresponding number of ACB parameter bits is 2 per subframe. That is, each subframe requiring 5 pulses allocates 2 bits to the ACB. For example, frame 6-6-5 allocates 2 bits to the ACB, frame 6-5-5 allocates 2+2 bits to the ACB, and so on. Understandably, embodiments of the invention are not restricted to only 5 and 6 bits, or 2 bits per pulse. More or less than this number of bits can be employed for the purposes of variable length subframe coding. It should also be noted, in the particular example of Table 2, that when a pulse representing 4 bits is allocated from the FCB to the ACB, 2 of the bits are allocated to the ACB and the remaining 2 bits are allocated to the Huffman codeword. That is, when bits representing a pulse in an FCB is removed from the FCB, the bits representing the pulse are distributed between the ACB and the variable length codeword. In this arrangement, pulses can be removed from the FCB codebook and applied to the codeword and ACB. This is a particularly beneficial approach for subframe encoding. For example, a speech frame can be represented by one or more subframes. A codebook configuration selector can determine a codebook configuration parameter for each subframe. The codebook configuration parameters of the subframes can be encoded into a single variable length codeword. Accordingly, increased compression can be achieved by taking advantage of the variable length coding scheme used to represent the number of pulses in the FCB.

Referring to FIG. 3, an alternate representation of Table 2 is shown. In particular, the configurations per subframe are shown in place of the pulses per subframe (Column 2), and the ACB bits per subframe are shown in place of the ACB bits (Column 4). The configurations per subframe reveal the codebook configuration, m, for each of the subframes with reference to Table 1.

TABLE 3

ACB/FCB Configuration Example over Multiple Subframes

| Huffman Code | Configuration per Subframe, m. | Huffman Bits | ACB Bits per Subframes | FCB Bits | Total bits |
|---|---|---|---|---|---|
| 0 | 1-1-1 | 1 | 0-0-0 | 93 | 94 |
| 100 | 1-1-2 | 3 | 0-0-2 | 89 | 94 |
| 101 | 1-2-1 | 3 | 0-2-0 | 89 | 94 |
| 110 | 2-1-1 | 3 | 2-0-0 | 89 | 94 |
| 11100 | 1-2-2 | 5 | 0-2-2 | 85 | 94 |
| 11101 | 2-1-2 | 5 | 2-0-2 | 85 | 94 |
| 11110 | 2-2-1 | 5 | 2-2-0 | 85 | 94 |
| 11111 | 2-2-2 | 5 | 2-2-2 | 81 | 92 |

For example, each 6 pulse FCB subframe corresponds to m=1, whereas each 5 pulse FCB subframe corresponds to m=2. For instance, 6-5-6 pulses per subframe in Table 2 corresponds to a 1-2-2 codebook configuration in the three respective subframes. Accordingly, the number of bits for each subframe changes by 2 bits depending on the number of pulses. Recall each pulse removed from the FCB requires 4 bits, though 2 bits are distributed to the ACB and 2 bits are distributed to the Huffman code. For instance, a 5 pulse FCB thus requires 2 bits, whereas a 6 pulse FCB thus requires 0 bits. The number of bits distributed between the ACB and the codeword fore each FCB pulse are not limited to this arrangement. More or less than 2 bits can be allocated to the ACB and the Huffman code.

Referring back to Table 2, the bits for each of the codebooks can be combined into a single codeword. That is, the FCB bits for all 3 subframes can be combined together to form a large composite codeword, the method of which is described in the related U.S. patent application Ser. No. 11/383,506, filed on the same day and contained herein. For example, the FCB bits can be efficiently encoded using a combinational factorial packing algorithm. The combinatorial algorithm provides an information segregation property that is more robust to bit errors. For the present example of Table 2, the total number of bits required for the 3 subframes having lengths 53, 53, 54 is calculated using the formula:

$$\text{FCB Bits}=\lceil \log_2({}^{53}FPC_{m_1}\cdot{}^{53}FPC_{m_2}\cdot{}^{54}FPC_{m_3})\rceil \tag{25}$$

where $m_1$, $m_2$, $m_3$ are the respective number of pulses per subframe, and ${}^{n}FPC_m$ is the number of combinations required for coding the Factorial Pulse Codebook (described in U.S. Pat. No. 6,236,960), and given as:

$${}^{n}FPC_m=\sum_{i=1}^{m}2^{i}\cdot{}^{m-1}C_{i-1}\cdot{}^{n}C_i \tag{26}$$

where:

$${}^{n}C_m=\frac{n!}{(n-m)!m!}. \tag{27}$$

The total number of bits for this example can then be observed in the last column of Table 2, where despite the variations in the number of Huffman bits, ACB parameter bits, and pulses per subframe, the total number of bits can be held virtually constant. Notably, referring back to FIG. 4, the error minimization unit/bit allocation unit/parameter quantization 408 can perform the parameter quantization and the coding which includes combinatorial coding, variable length Huffman coding, and factorial packing.

Figure 6:
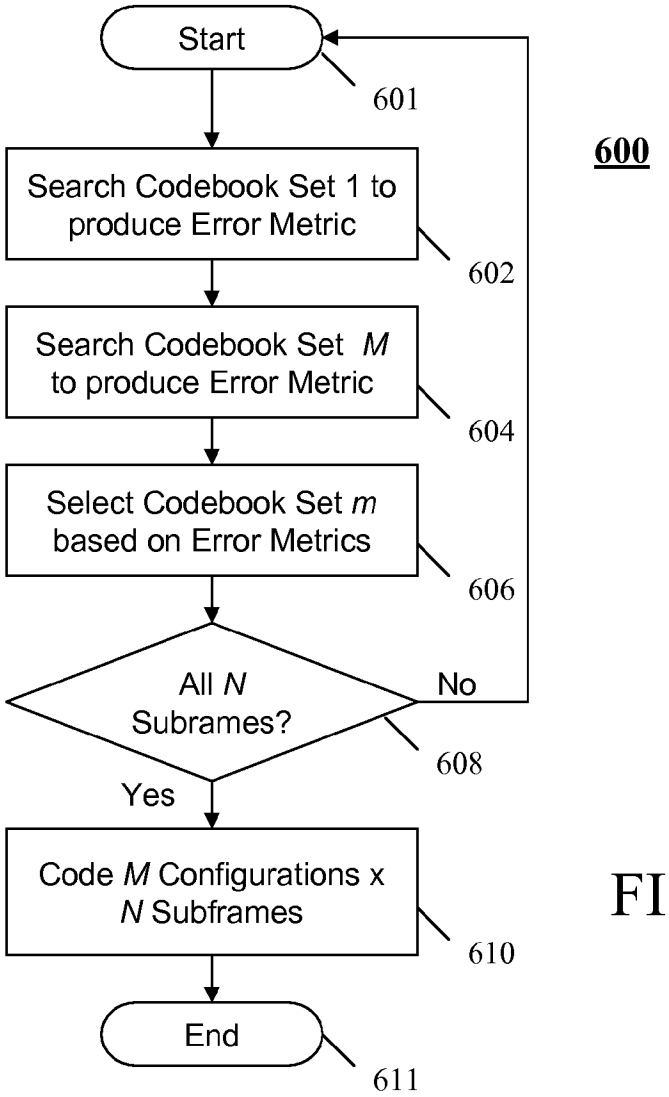
FIG. 6 is a logic flow diagram of steps executed by a CELP encoder in determining whether to perform a joint search process or a sequential search process in accordance with another embodiment of the present invention.

Referring to FIG. 6, a flowchart 600 of subframe encoding is shown. The flowchart 600 is similar in principle to the flowchart 500. It should be noted, that reference will be made to FIG. 4 for illustrating the method steps. However, the method 600 can be practiced in more or fewer than the number of steps shown. In particular, the method 600 determines the codebook configuration providing the optimal bit-allocations to the codebooks for producing the best estimate of the encoded speech, in a least square errors sense. At step 601, the method 600 can start.

At step 602 through 604, for the first subframe, a set of M codebook configurations can be searched and a first codebook configuration parameter m can be produced at step 606. For example, referring to FIG. 4, the error minimization unit 408 can generate M error performance metrics for the M ACB 402-403 set in accordance with the processing previously described in FIG. 4.

$$m=\arg\max\{\epsilon_1',\ldots,\epsilon_M'\},$$

That is, a performance metric can be generated for each of the M ACB codebooks, from which a configuration parameter m is selected.

At step 606, the codebook configuration corresponding to the maximum performance metric for the first codebook and the second codebook can be selected. More than two codebooks can be provided though only two are shown for exemplary illustration. The principles of operation can be equally applied to two more codebook sets which is herein contemplated. In one arrangement, the number of codebook sets can equal the number of codebook configurations, M.

At step 608, the method steps 602 to 606 can be repeated for each of the subframes. Upon identifying the codebook configurations yielding the highest performance metrics, the multiple codebook-related parameters $\tau_m$, $\beta$, $k_m$ and $\gamma$ can be determined in the manner as described in accordance with FIG. 3. At step 610, the M configurations of the N subframes can be coded based on Table 2. For example, the codebook configuration and multiple codebook-related parameters can be combined using variable length coding or combinatorial coding. Understandably, combinational coding techniques can be applied to the bits representing the codebook configuration parameters for each of the subframes. The bits of the subframes can be combined to reduce the overhead due to the coding of the multiple subframes.

Figure 7:
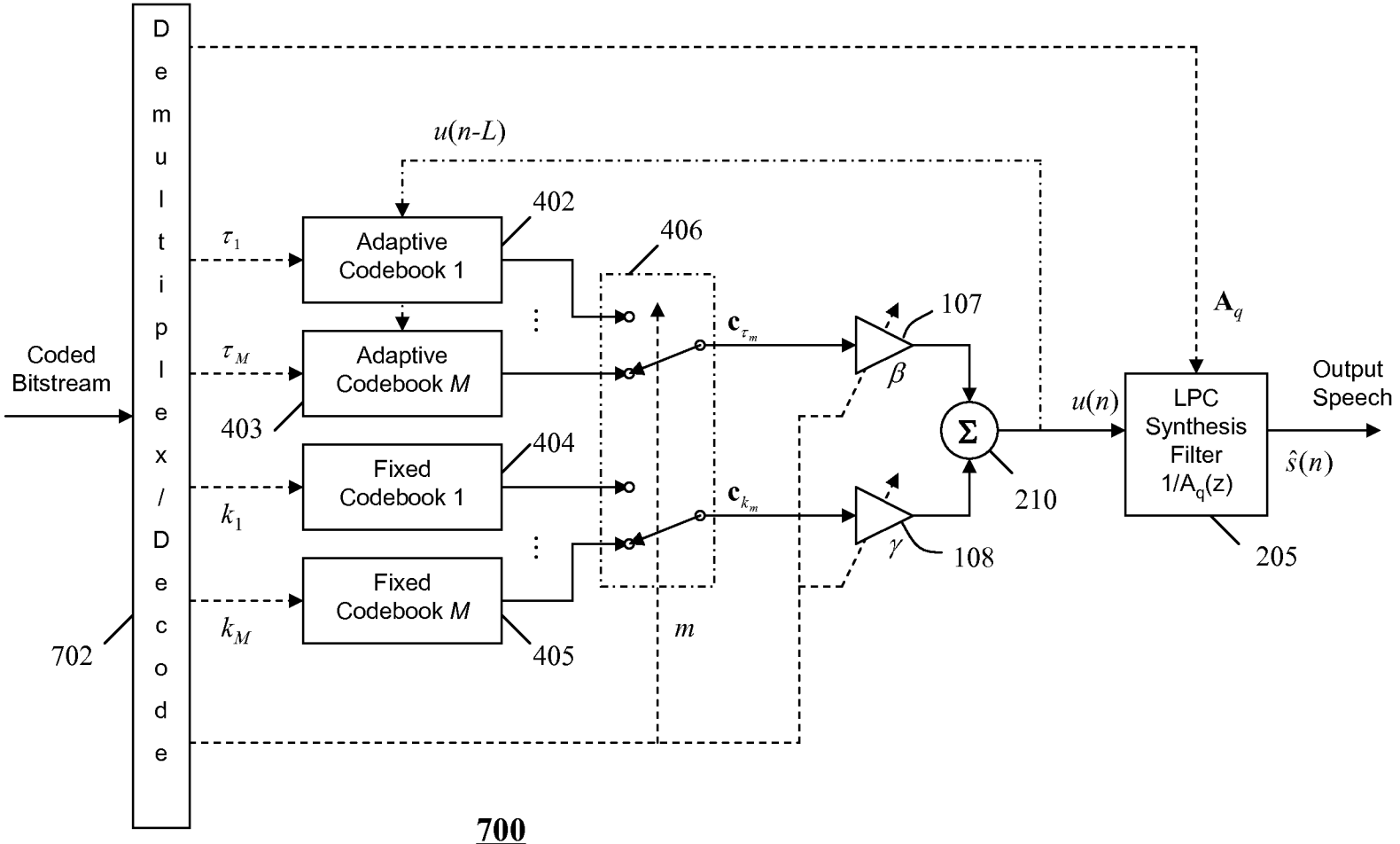
FIG. 7 is a block diagram of a CELP decoder in accordance with an embodiment of the present invention.

FIG. 7 depicts a Code Excited Linear Prediction (CELP) decoder 700 using a selectable codebook configuration in accordance with the embodiments of the invention. As shown in FIG. 7, the first excitation sequence or "codevector", $c_{\tau m}$, is generated from one of the m adaptive codebooks 402 (ACB)

using the appropriate codebook index, $\tau_m$. The codevector $c_{\tau m}$ models the long term (or periodic) component having a period $\tau$ of a speech signal. The codevector is scaled using the ACB gain factor $\beta$ 109 to produce a first synthetic signal, $\beta c_{\tau m}$. The second excitation sequence or "codevector" $c_{km}$, is generated from one of the fixed codebooks 404 (FCB) using the appropriate codebook index $k_m$. This codevector is scaled using the FCB gain factor $\gamma$ 208 to produce a second synthetic signal, $\gamma c_{km}$. The combiner 210 adds the first synthetic signal and the second synthetic signal to produce the total excitation u (n), which is used as the input to the LPC synthesis filter 205. The LPC synthesis filter models the coarse short term spectral shape, commonly referred to as "formants", to produce the speech output. Additionally, the total excitation signal u (n) is used as the adaptive codebook for the next block of synthesized speech.

The demultiplexer 702, parses the codebook parameter from the coded bit-stream to determine the codebook selections. For example, the demultiplexer can parse the configuration parameter and determine m using Table 1 for identifying codebooks to use during decoding. The codebook-related parameters $\tau_m$ and $k_m$ identify the indexes to the appropriate ACB and FCB codebook, respectively. The parameters $\beta$ and $\gamma$ identify the gain scaling applied by to the ACB and FCB codevectors, respectively. Recall, the multiple codebook-related parameters were determined after codebook configuration, m, was selected. The encoder 400 determined the multiple codebook-related parameters $\tau_m$, $\beta$, $k_m$ and $\gamma$ through an error minimization process that included the optimal bit-allocation assignments and optimal gains scalings.

In another arrangement, the demultiplexer 702 parses the codebook parameter from the coded bit-stream to determine the bit allocations assigned to each codebook. For example, the demultiplexer 702 can identify the Huffman code from the received bit sequence and determine the number of bits used in the ACB and FCB codebooks according to Table 2.

For example, upon receiving a frame of N bits, the demultiplexer 702 can identify the Huffman code which inherently identifies the codebook configuration; that is, the bit-allocation to the respective ACB and FCB. For instance, if the Huffman code is 100, according to Table 2, 2 bits can be assigned to ACB 402, and 89 bits can be assigned to FCB 404. In this particular arrangement, the remaining M-1 ACB codebooks and M-1 FCB codebooks are not employed; this is because the number of bits used by each codebook is established by the demultiplexer in view of the codebook configuration. For example, the first subframe includes 6 pulses from FCB, the second subframe includes 6 pulses from FCB, and the third subframe includes 5 pulses from FCB. Notably, the pulse removed from the third subframe provides the 2 bits to the ACB. The demultiplexer 702 can select the codebook configuration, m, from the demultiplexed bit stream for each speech frame, or subframe, in order to generate the first synthetic signal and second synthetic signal. Combiner 210 can combine the first synthetic signal and second synthetic signal into the excitation signal u(n) which is input to the synthesis filter 205. The synthesis filter 205 can receive the filter coefficients, $A_q$, from the demultiplexer 702. The excitation sequence u(n) is passed through the synthesis filter 205 to eventually generate the output speech signal in accordance with the invention.

While the present invention has been particularly shown and described with reference to particular embodiments thereof, it will be understood by those skilled in the art that various changes may be made and equivalents substituted for elements thereof without departing from the scope of the invention as set forth in the claims below. Accordingly, the specification and figures are to be regarded in an illustrative rather then a restrictive sense, and all such changes and substitutions are intended to be included within the scope of the present invention. In addition, the invention has been shown to comprise a specific instance of Adaptive and Fixed Codebook types, when in fact any such Adaptive and/or Fixed Codebook structures may be used without departing from the spirit or scope of the present invention. The Adaptive Codebook may also fall into any class of pitch related codebooks often referred to by those of ordinary skill in the art as "Virtual Codebooks" or "Long-Term Predictors".

Furthermore, while a specific example for selecting an ACB/FCB configuration has been described, many such selection mechanisms may be employed, and may depend on several factors in the design of the respective system, including codebook types, target bit rates, and number of configurations. While the codebook types presented imply separate physical elements, the actual implementation of such elements may be optimized to reduce computational complexity, physical memory size, and/or require hardware circuitry. For example, the ACB components are described as in terms of separate physical elements, however, one that is of ordinary skill in the art may appreciate that the ACB memories across configurations may be common, and that the difference in codebook structure may be the meaning and interpretation (i.e., he encoding/decoding) of the respective input indices. The same may be true of the FCB components which may utilize other scalable algebraic or fixed memory codebooks (such as VSELP) which may not occupy separate physical memories, but rather may share both codebook memory and/or program codes for execution and/or efficient implementation of the described method and apparatus. Additionally, the configuration selection criteria may be based purely on the final error signal which may be based on the combined ACB/FCB contributions, however, it should be noted that the complexity of such an embodiment may be significantly higher than the example described in the preferred embodiment of the present invention.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any variation thereof, are intended to cover a non-exclusive inclusion, such that a process, method, article, or apparatus that comprises a list of elements does not include only those elements but may include other elements not expressly listed or inherent to such process, method, article, or apparatus. It is further understood that the use of relational terms, if any, such as first and second, top and bottom, and the like are used solely to distinguish one from another entity or action without necessarily requiring or implying any actual such relationship or order between such entities or actions.

What is claimed is:

1. A method for analysis-by-synthesis encoding of an information signal comprising steps of:

generating a reference signal based on the information signal;

generating a first synthetic signal based on at least a first pitch related codebook;

generating a second synthetic signal based on at least a second pitch related codebook;

identifying a fixed codebook from a plurality of fixed codebooks based on the first synthetic signal and the second synthetic signal;

selecting, via a processor, a codebook configuration parameter based on the first synthetic signal and the second synthetic signal and the fixed codebook, wherein the codebook configuration parameter identifies the fixed codebook;

outputting the one or more codebook configuration parameters for use in reconstructing an estimate of the input signal;

wherein a set of codevectors within the first pitch related codebook differs from a set of codevectors in the second pitch related codebook by a number of bits assigned to the codevectors in each codebook.

2. The method of claim 1, further comprising encoding the one or more codebook configuration parameters in a variable length codeword.

3. The method of claim 1, wherein a codebook configuration parameter identifies a bit allocation for a pitch related codebook and a fixed codebook, wherein the bit allocation is an allocation of bits to the pitch related codebook and an allocation of bits to the fixed codebook such that the pitch related codebook has a first distribution of bits and the fixed codebook has a second distribution of bits.

4. The method of claim 1, further comprising evaluating at least one performance metric between the reference signal and first and second synthetic signals comprised of the first error metric and the first prediction gain and the second error metric and the second prediction gain correspondingly for selecting a codebook configuration parameter.

5. The method of claim 4, wherein a first performance metric is a squared error metric and a second performance metric is a prediction gain metric.

6. The method of claim 3, further comprising dynamically allocating bits to the pitch related codebook and the fixed codebook based on a codebook configuration parameter.

7. The method of claim 1, wherein the pitch related codebook comprises at least one from the set of adaptive codebooks, virtual codebooks, and long-term predictors.

8. The method of claim 4, wherein evaluating a performance metric comprises:

calculating a mean square error between the reference signal and one of the synthetic signals; and determining a codevector in a codebook that minimizes the mean square error.

9. The method of claim 1, wherein the first comparison includes an error bias, such that a codebook configuration corresponding to the second error metric is selected when the second error metric exceeds the first error metric by the error bias.

10. The method of claim 1, wherein second comparison includes a prediction gain bias, such that a codebook configuration corresponding to the second prediction gain is selected when the second prediction gain exceeds the first prediction gain by the gain bias.

11. The method of claim 6, further comprising:

allocating bits from the fixed codebook to the pitch related codebook, wherein the bits from the fixed codebook are distributed to the pitch related codebook and a variable length codeword.

12. The method of claim 1 wherein the codebook configuration parameter additionally identifies either the first or the second pitch related codebook.

13. The method of claim 1 wherein the plurality of fixed codebooks differ from each other by a number of bits assigned to the codevectors in each codebook.

14. A method for decoding parameters for use in reconstructing an estimate of an encoder input signal comprising steps of:

receiving a variable length codeword representing at least one codebook configuration parameter, wherein the codebook configuration parameter identifies a fixed codebook;

determining one of a plurality of fixed related codebooks to utilize based on the codebook configuration parameter;

receiving a first code related to a pitch related codebook; wherein the pitch related codebook is one of a plurality of pitch related codebooks, and wherein a set of codevectors the pitch related codebooks differs from one another by a number of bits assigned to the codevectors in each codebook;

receiving a second code related to the fixed codebook;

decoding, via a processor, the codes related to the pitch related codebook and the fixed codebook based on the codebook configuration parameter; and generating an estimate of the encoder input signal from the pitch related codebook and fixed codebook.

15. The method of claim 14, wherein the decoding of the codes identifies a first distribution of bits for the adaptive codebook and a second distribution of bits for the fixed codebook.

16. The method of claim 14, wherein the variable length codeword is a Huffman code.

17. The method of claim 14 wherein the codebook configuration parameter additionally identifies either the pitch related codebook.

18. The method of claim 14 wherein the plurality of fixed codebooks differ from each other by a number of bits assigned to the codevectors in each codebook.

19. An analysis-by-synthesis codebook selector apparatus comprising:

a processor operable to perform the functions of:

a weighting filter for generating a weighted speech signal from a speech signal;

a first combiner for subtracting a zero input response from the weighted speech signal for producing a weighted reference signal;

a first filter for generating a first synthetic signal based on at least a first pitch related codebook;

a second combiner for generating a first performance metric between the weighted reference signal and the first synthetic signal;

a second filter for generating a second synthetic signal based on at least a second pitch related codebook, wherein the first pitch related codebook differs from the second pitch related codebook by a number of bits assigned to the codevectors in each codebook;

a third combiner for generating a second performance metric between the weighted reference signal and the second synthetic signal;

an adaptive bit allocation unit for selecting a codebook configuration parameter based on the first and second performance metrics, wherein the codebook configuration parameter identifies fixed codebook from a plurality of fixed codebooks.

20. The analysis-by-synthesis codebook selector of claim 19, wherein the codebook configuration parameter identifies a bit allocation for the adaptive codebook and a fixed codebook.

21. The analysis-by-synthesis codebook selector of claim 19, further comprising:

a variable length coder for encoding multiple codebook configuration parameters to produce a variable length code.

22. The analysis-by-synthesis codebook selector of claim 21, wherein bits from a fixed codebook are distributed to the adaptive codebook and the variable length codeword to achieve a performance metric.

23. The selector of claim 19 wherein the codebook configuration parameter additionally identifies either the first or the second pitch related codebook.

24. The selector of claim 19 wherein the plurality of fixed codebooks differ from each other by a number of bits assigned to the codevectors in each codebook.

25. A method for analysis-by-synthesis subframe encoding of an information signal comprising steps of:

generating a reference signal based on the information signal;

generating multiple synthetic signals using multiple pitch related codebooks wherein a first pitch related codebook differs from a second pitch related codebook by a number of bits assigned to the codevectors in each codebook;

determining a performance metric based on the reference signal and the multiple synthetic signals;

selecting, via a processor, at least one codebook configuration parameter based on performance metric, wherein the codebook configuration parameter identifies a fixed codebook from a plurality of fixed codebooks;

encoding the at least one codebook configuration parameter in a variable length codeword; and conveying the variable length codeword for use in reconstructing an estimate of the input signal.

26. The method of claim 25, wherein the performance metric is at least one of least one of a multiple mean square error performance metric and a prediction gain metric.

* * * * *